US005617965A

United States Patent [19]

Hawryszkow

[11] Patent Number: 5,617,965

[45] Date of Patent: Apr. 8, 1997

[54] INTERLOCKING TYPE MECHANISM FOR A SLACKLESS DRAWBAR ASSEMBLY USED ON A RAILWAY FREIGHT CAR

[75] Inventor: Michael G. Hawryszkow, Munster, Ind.

[73] Assignee: Westinghouse Air Brake Company, Wilmerding, Pa.

[21] Appl. No.: 490,873

[22] Filed: Jun. 15, 1995

[51] Int. Cl.[6] ..... B61G 9/00

[52] U.S. Cl. ..... 213/75 R; 213/62 R; 213/188

[58] Field of Search ..... 213/50, 62 R, 213/75 R, 77, 80, 85, 96, 98, 182, 188; 105/4.1, 4.2; 280/492, 493, 494, 504, 514

[56] References Cited

U.S. PATENT DOCUMENTS

| | | | |
|---|---|---|---|
| 580,122 | 4/1897 | Carter | 213/188 |
| 1,557,060 | 10/1925 | Kadel | 213/67 A |
| 2,241,353 | 5/1941 | Kinne et al. | 213/72 |
| 2,334,034 | 11/1943 | Richards | 213/188 |
| 3,985,236 | 10/1976 | Martin | 213/75 R |
| 4,336,758 | 6/1982 | Radwill | 213/75 R |
| 4,531,648 | 7/1985 | Paton | 213/50 |
| 4,555,033 | 11/1985 | Miller | 213/51 |
| 4,580,686 | 4/1986 | Elliott | 213/62 |
| 4,700,853 | 10/1987 | Altherr et al. | 213/50 |
| 4,846,358 | 7/1989 | Rhen | 213/64 |
| 4,946,052 | 8/1990 | Kaim et al. | 213/75 R |
| 4,962,861 | 10/1990 | Wiebe | 213/75 R |
| 5,035,338 | 7/1991 | Kaufhold et al. | 213/50 |
| 5,201,827 | 4/1993 | Glover et al. | 213/50 |
| 5,232,106 | 8/1993 | Hawthorne et al. | 213/62 R |
| 5,271,511 | 12/1993 | Daugherty, Jr. et al. | 213/75 R |

*Primary Examiner*—S. Joseph Morano
*Attorney, Agent, or Firm*—James Ray & Associates

[57] ABSTRACT

An interlocking mechanism positioned intermediate each end of a drawbar member portion of a slackless drawbar assembly which includes an elongated member engageable at a first end thereof to an end of a first male connection member and at an axially opposed second end to an end of a second male connection member of such drawbar assembly. At least one of such elongated member and such end of such first and such second male members include at least a hollow portion so that one of such elongated member can be disposed in such at least a hollow portion of such end of such first and such second male members, and such end of such first and such second male members can be disposed in the at least a hollow portion of such elongated member. A first aperture, having a first predetermined shape, is formed through the elongated member adjacent at least one predetermined first end and such axially opposed second end thereof. A second aperture, having a second predetermined shape, is formed through a respective one of such end of such first and such second male members. A plate like connection device, having a third predetermined shape, is disposed in each of such first aperture formed through said elongated member and said second aperture formed through such respective one of such end of such first and such second male members for connecting such elongated member to such end of such first and such second male members.

15 Claims, 1 Drawing Sheet

INTERLOCKING TYPE MECHANISM FOR A SLACKLESS DRAWBAR ASSEMBLY USED ON A RAILWAY FREIGHT CAR

CROSS-REFERENCE TO RELATED APPLICATION

The present patent application is closely related to another earlier filed patent application entitled, "Interlocking Slackless Drawbar Assembly For Railway Freight Car And An Interlocking Mechanism Therefor", that was filed on Jun. 28, 1995 and which was assigned Ser. No. 08/495,883. This earlier filed patent application is, also, assigned to the assignee of the present invention and the teachings of such earlier filed application are incorporated herein by reference thereto.

FIELD OF THE INVENTION

The present invention relates, in general, to railway type freight car slackless drawbar assembly arrangements which are utilized, in the railroad industry, to connect together the adjacently disposed ends of a pair of such freight cars in a substantially semipermanent manner and, more particularly, the instant invention relates to an improved interlocking type mechanism which can be incorporated into the elongated drawbar member portion of either a new slackless drawbar assembly or which can, also, be retrofitted into an existing slackless drawbar assembly and thereby enable such railway freight cars to be more easily and readily disconnected from and/or reconnected into a train consist.

BACKGROUND OF THE INVENTION

A number of different arrangements of slackless type drawbar assemblies have been utilized by the railroad industry for several years, prior to the development of the present invention, as a means of connecting the adjacently disposed ends of a pair of freight cars together in a substantially semipermanent fashion. As is quite well recognized in the relevant freight car coupling art, each of these prior art type slackless drawbar assemblies have been equipped with a one piece drawbar member portion as one of the critical component parts thereof.

Such one piece drawbar member portion, of all these prior art type drawbar assemblies, is rotatably secured at each end thereof within the longitudinal opening of the center sill portion of each of such pair of freight cars closely adjacent a respective end thereof. This is the arrangement, even though each of the several different manufacturers and/or suppliers of slackless type drawbar assemblies to the railroad industry will supply them with their own particular design.

In the railroad industry, it is equally very well recognized that there will be at least as many as five such railway freight cars connected together using these slackless type drawbar assembly arrangements. Consequently, if it is assumed for the purposes of illustration only that there are five such freight cars which have been interconnected in this manner, if only a single end of only a single one of the four such slackless type drawbar assemblies required is in need of either repair or maintenance, then all five of the freight cars must be removed from any revenue generating type service while either such repair or maintenance is being performed.

In actual experience gained over the past few years, it has been conclusively demonstrated to the railroad industry that these slackless drawbar assembly arrangements will, as a general rule, require relatively frequent maintenance. One of the primary reasons why they require a significant amount of costly maintenance is because the design of these prior art type slackless drawbar assemblies requires that a relatively large number of component parts be used.

In addition, a number of these component parts will at least include some surfaces which are disposed in frictional engagement and which, also, must possess the capability of moving with respect to one another during in-track service. Such surfaces which are frictionally engaged will at least include one concave shaped surface and one convex shaped surface as well as a number of flat surfaces.

Furthermore, it is generally well recognized in the railway freight car coupling art that during such in-track service, each of these frictionally engaged surfaces will periodically be subjected to relatively large forces being exerted on them. Furthermore, at the same time, some relative movement will normally be occurring between such frictionally engaged surfaces. In the most extreme circumstances, the forces such frictionally engaged surfaces may be subjected to can be expected to exceed at least about one million pounds.

As would be expected, by those persons who are skilled in the mechanical art, the relative movement between these frictionally engaged surfaces will generate a significant amount of heat energy, particularly when they are being subjected to such extreme loads, which will significantly reduce the useful life span of these components.

Nevertheless, these slackless type drawbar assemblies, which are known to be in use at the present time, have generally provided the railroad industry with a much more modern style freight car coupling arrangement. For example, these slackless drawbar assemblies have substantially eliminated the need for a relatively expensive draft gear assembly as well as other freight car coupling components that were normally required before their introduction.

Furthermore, these slackless drawbar assemblies have generally resulted in an overall net decrease in the empty weight of such freight cars. This overall net weight reduction of such freight car is an extremely important factor to be taken into consideration by the user of such railway freight car in view of the ever rising energy cost.

It is believed to be equally well recognized, in the railroad industry, that these slackless drawbar assemblies are primarily installed on selected freight cars which will be utilized in a dedicated service type of application. The reason for this is that most of the freight cars that are utilized in this dedicated type service will not, as a general rule, require that they be uncoupled except for any routine maintenance and/or possible repair being required.

By way of example only, such freight cars which generally are used in such dedicated type service will at least include: coal cars, automobile and light truck transport cars and certain tank cars.

These slackless type drawbar assemblies have, nevertheless, gained a rather widespread acceptance in the railroad industry over the past several years in spite of the number of disadvantages which were discussed in some detail above. This would be expected, however, because there are a number of significant advantages that were gained by such railroad industry, in comparison to the older style standard type coupling arrangements which were and still are being used. Experience has demonstrated that these advantages far outweigh the disadvantages and such slackless drawbar assemblies have proven to the railroad industry over an extended period of time to be quite cost effective.

SUMMARY OF THE INVENTION

The present invention provides an interlocking type mechanism which is positioned intermediate the first and second end portions of a drawbar member portion of a slackless type drawbar assembly. Such slackless drawbar assembly is utilized in coupling the adjacently disposed ends of a pair of railway freight cars together in a substantially semipermanent fashion, as is known in the railway coupling art. Such interlocking type mechanism includes an elongated member portion which is engageable at a first end thereof to an end of a first male connection member portion and at an axially opposed second end thereof to an end of a second male connection member of such slackless drawbar assembly. At least one of the elongated member portion and such end of such first and such second male connection members includes at least a hollow portion. In this manner, one of such elongated member portion can be disposed in such at least a hollow portion of such end of such first and such second male connection members and such end of such first and such second male connection members can be disposed in such at least a hollow portion of such elongated member portion. There is a first aperture, having a first predetermined shape, formed through such elongated member portion adjacent at least one predetermined first end and such axially opposed second end of the elongated member portion. A second aperture, having a second predetermined shape, is formed through a respective one of such end of such first and such second male connection members. Finally there is provided a plate like connection means, having a third predetermined shape. This plate-like connection means is disposed in each of the first aperture formed through such elongated member portion and the second aperture formed through such respective one of such end of such first and such second male connection members for connecting such elongated member portion to such end of such first and such second male connection members in a slackless manner.

OBJECTS OF THE INVENTION

It is, therefore, one of the primary objects of the present invention to provide an interlocking type mechanism which can be disposed in a drawbar member portion of a slackless type drawbar assembly that will enable such slackless drawbar assembly to be more easily and readily connected and/or disconnected when required.

Another object of the present invention is to provide an interlocking type mechanism which can be disposed in a drawbar member portion of a slackless type drawbar assembly that will substantially minimize the downtime of a railway freight car for necessary repairs and/or maintenance.

Still another object of the present invention is to provide an interlocking type mechanism which can be disposed in a drawbar member portion of a slackless type drawbar assembly that can be relatively easily retrofitted into an existing drawbar member portion of existing slackless drawbar assemblies.

Yet another object of the present invention is to provide an interlocking type mechanism which can be disposed in a drawbar member portion of a slackless type drawbar assembly that is relatively simple in design.

A further object of the present invention is to provide an interlocking type mechanism which can be disposed in a drawbar member portion of a slackless type drawbar assembly that can be used with either a rotary or non-rotary type slackless drawbar assembly.

It is an additional object of the present invention to provide an interlocking type mechanism which can be disposed in a drawbar member portion of a slackless type drawbar assembly that will enable a single freight car requiring repair and/or maintenance to be removed from service.

Another object of the present invention is to provide an interlocking type mechanism which can be disposed in a drawbar member portion of a slackless type drawbar assembly that will require a minimum amount of maintenance.

Still yet another object of the present invention is to provide an interlocking type mechanism which can be disposed in a drawbar member portion of a slackless type drawbar assembly that will enable the user to mix and/or match one end of one manufacturer's slackless drawbar assembly with one end of a different manufacturer's slackless drawbar assembly in a unit train.

Yet still another object of the present invention is to provide an interlocking type mechanism which can be disposed in a drawbar member portion of a slackless type drawbar assembly that is cost effective for the end user when compared to the presently used slackless drawbar assemblies.

It is another object of the present invention to provide a drawbar member portion of a slackless type drawbar assembly for connecting the adjacently disposed ends of a pair of railway freight cars together in a substantially semipermanent fashion which includes a pair of an interlocking type mechanisms disposed therein.

A still further object of the present invention is to provide a slackless type drawbar assembly for connecting the adjacently disposed ends of a pair of railway freight cars together in a substantially semipermanent fashion which includes an interlocking type mechanism disposed in the drawbar member portion of such slackless drawbar assembly.

An additional object of the present invention is to provide a slackless drawbar assembly for connecting the adjacently disposed ends of a pair of railway freight cars together in a substantially semipermanent fashion which includes at least one interlocking type mechanism disposed in the drawbar member portion of such slackless drawbar assembly that can be retrofitted onto existing freight cars.

In addition to the various objects and advantages of the present invention which have been generally described above, there will be various other objects and advantages of the invention that will become more readily apparent to those persons who are skilled in the relevant art from the following more detailed description of such invention, particularly, when such detailed description is taken in conjunction with the attached drawing Figures and with the appended claims.

Figure 1:
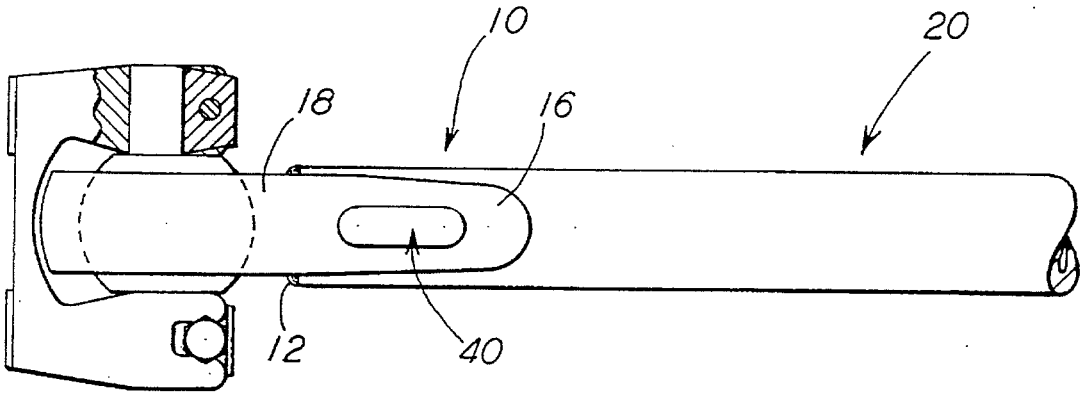
FIG. 1 is a top view of a presently preferred embodiment of the interlocking type mechanism for the drawbar member portion of a slackless type drawbar assembly.

BRIEF DESCRIPTION OF THE PRESENTLY PREFERRED AND VARIOUS ALTERNATIVE EMBODIMENTS OF THE INVENTION

Prior to proceeding to the much more detailed description of the present invention, it should be noted that identical components which have identical functions have been identified with identical reference numerals throughout the several views illustrated in the drawing Figures, for the sake of clarity and understanding of the invention.

In addition, it should be further noted here, applicants would expect that essentially all of the advantages which are provided by the interlocking type mechanism of the present invention could be easily achieved by simply incorporating the interlocking mechanism of the present invention into virtually all of the presently known slackless type drawbar assemblies which are in use in the railroad industry at the present time. Accordingly, even though such interlocking type mechanism will be described hereinafter in conjunction with one specific embodiment of a slackless type drawbar assembly it is not considered to be limited either thereto or thereby.

Figure 2:
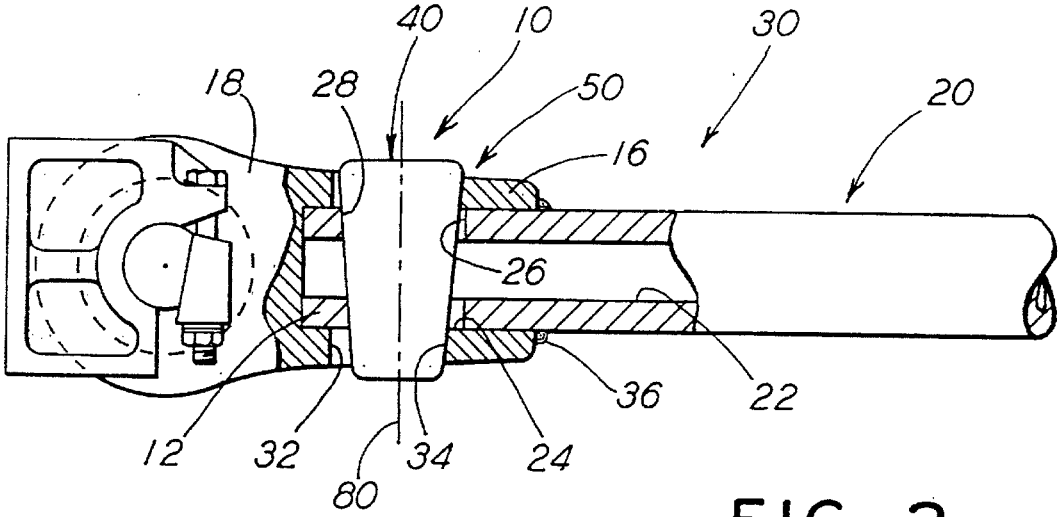
FIG. 2 is a side elevation view, partially in cross-section, of the interlocking type mechanism for the drawbar member portion of a slackless type drawbar assembly illustrated in FIG. 1.

Now reference is made, more particularly, to both FIG. 1 and FIG. 2 illustrated in the drawing. Shown therein is a presently preferred embodiment of an interlocking type mechanism, generally designated 10. Such interlocking type mechanism 10 is positioned intermediate the first end portion 12 and the axially opposed second end portion (not shown) of a drawbar member portion, generally designated 20, of a slackless type drawbar assembly arrangement, generally designated 30. Such slackless drawbar assembly 30 is utilized to couple one end of a first railway freight car (not shown) to an adjacently disposed end (not shown) of a second railway freight car (not shown) together in a substantially semipermanent fashion.

Such interlocking type mechanism 10 includes an elongated member portion, which forms such drawbar member portion 20, of the slackless drawbar assembly 30. The elongated member portion 20 is engageable at the first end 12 thereof to an end 16 of a first male connection member portion 18 and at an axially opposed second end (not shown) thereof to an end (not shown) of a second male connection member portion (not shown) of such slackless drawbar assembly 30.

At least one of such elongated member portion 20 and such end 16 of such first male connection member portion 18 and such second male connection member portion includes at least a generally hollow portion 22 and 24, respectively. In this manner, one of such elongated member portion 20 can be disposed in such at least a generally hollow portion 24 of such end 16 of such first male connection member portion 18 and an end of such second male connection member and such end 16 of such first 18 and such second male connection members can be disposed in the at least a generally hollow portion 22 of such elongated member portion 20.

In the presently preferred embodiment of the invention of such interlocking type mechanism 10, the elongated member portion 20 of the slackless drawbar assembly 30 will be substantially hollow. In this manner, for example, such elongated member portion 20 can be readily and economically fabricated from a length of extra heavy steel pipe. Although not presently preferred, such end 16 of the first male connection member portion 18 and the end of such second male connection member portion can be formed solid and inserted into respective ends of such elongated member portion 20.

However, in the presently more preferred embodiment of such interlocking type mechanism 10, each of such end 16 of such first male connection member portion 18 and the end of such second male connection member portion is generally hollow and such first end 12 of the elongated member portion 20 is disposed in such end 16 of the first male connection member portion 18 and at an axially opposed second end of such elongated member portion 20 is disposed in such end of such second male connection member portion of such slackless drawbar assembly 30. Nevertheless, even though such first end 12 of the elongated member portion 20 is disposed in such end 16 of the first male connection member portion 18 and the axially opposed second end thereof is disposed in such end of such second male connection member portion it is preferably that such elongated member portion 20 be hollow for weight reduction purposes.

There is a first aperture 26, having a first predetermined shape, formed through such elongated member portion 20 adjacent at least one predetermined one of the first end 12 and such axially opposed second end thereof.

In the presently preferred embodiment of such interlocking type mechanism 10, the first predetermined shape of such first aperture 26 formed through such elongated member portion 20 is an elongated slot-like shape. Additionally, it is preferably that at least one end portion 28 of such elongated slot-like shaped first aperture 26 will include a wall-like portion having a predetermined generally tapered surface.

A second aperture 32, having a second predetermined shape, is formed through a respective one of such end 16 of the first male connection member portion 18 and the end of such second male connection member.

In a similar manner, in the presently preferred embodiment of such interlocking type mechanism 10, such second predetermined shaped of the second aperture 32 formed through a respective one of such end 16 of the first male connection member portion 18 and such end of the second male connection member will be an elongated slot-like shape. In this embodiment, it is preferable that at least one end portion 34 of such, elongated slot-like shaped, second aperture 32 includes a tapered wall-like portion disposed substantially opposite such tapered wall portion formed on the at least one end portion 28 of such, elongated slot-like shaped, first aperture 26.

The final essential component of such interlocking type mechanism 10 is at least one plate-like connection means, generally designated 40, which has a third predetermined shape. Such at least one plate-like connection means 40 is disposed in each of the first aperture 26 formed through such elongated member portion 20 and the second aperture 32 formed through such respective one of the end 16 of such first male connection member portion 18 and the end of such second male connection member portion. In this manner, the connection of such elongated member portion 20 to the end 16 of such first male connection member portion 18 and the end of such second male connection member in a substantially slackless manner is achieved.

According to the most presently preferred embodiment of such interlocking type mechanism 10, this third predetermined shape of such plate-like connection means 40 will be wedge shaped.

The interlocking type mechanism 10, according to the presently preferred embodiment of the invention, will further include an at least one retaining means, generally designated 50. This retaining means 50 is engageable with such plate-like connection means 40 and one of the first end 12 of such elongated member portion 20 and the first end 16 of such first male connection member portion 18 adjacent a respective such first aperture 26 and the second aperture 32 for retaining such plate-like connection means 40 in each of the first aperture 26 formed through such elongated member portion 20 and the second aperture 32 formed through such end 16 of the first male connection member portion 18.

Such retaining means 50 will, preferably, be at least one of a weldment (not shown), a bolt (not shown), a clamp (not shown) and a friction fit, which is the presently preferred retaining means 50. Such friction fit retaining means 50 is preferred because it will enable the assembly and/or disassembly of such slackless drawbar assembly 30 to be accomplished in a relatively fast and easy manner.

The interlocking type mechanism 10, of the presently preferred embodiment of the invention, will further include a weldment 36. Such weldment 36 is disposed around the elongated member portion 20 and adjacent an outermost edge of such respective one of such end 16 of such first male connection member portion 18 and the end of such second male connection member portion.

In the most presently preferred embodiment of the interlocking type mechanism 10 for use with a slackless type drawbar assembly 30, according to the present invention, such elongated member portion 20 will include an aperture formed through each of such first end 12 and the axially opposed second end thereof. Each of these apertures will preferably have a substantially identical shape.

Additionally, in this embodiment of the invention, each of such first male connection member portion 18 and such second male connection member portion will include an aperture formed therethrough, which will likewise have substantially identical predetermined shapes.

In this arrangement of the slackless type drawbar assembly 30, such interlocking type mechanism 10 will, also, include a pair of plate-like connection means 40, which preferably will exhibit substantially identical predetermined shapes. The first one of such pair of plate-like connection means 40 will be disposed in the first aperture 26 formed through such first end 12 of the elongated member portion 20 and such second aperture 32 formed through such first male connection member portion 18. The second one of these pair of plate-like connection means will be disposed through the aperture formed through such axially opposed second end of the elongated member portion 20 and such aperture formed through such second female connection member portion.

At least one, and preferably both, of such pair of plate-like connection means 40 will have a first generally rectangular cross sectional shape. Such first generally rectangular cross sectional shape will be disposed in a vertical plane located substantially perpendicular to a longitudinal axis 80 of such at least one of said pair of plate-like connection means 40 in the more presently preferred interlocking type mechanism 10.

In addition, in the presently preferred embodiment of such interlocking type mechanism 10, such at least one, and preferably both, of such pair of plate-like connection means 40 will include a second generally rectangular cross sectional shape. This second generally rectangular cross sectional shape will be disposed in a vertical plane located substantially along the longitudinal axis 80 of such at least one of such pair of plate-like connection means 40. It is to be understood that each of the vertical planes are disposed perpendicularly with respect to each other and to the page on which such at least one of such pair of plate-like connection means 40 is illustrated.

In this interlocking type mechanism 10, the plate-like connection means 40 engages only a portion of each of such first aperture 26 and such second aperture 32.

While a presently preferred and various additional alternative embodiments of the instant invention have been described in detail above in accordance the patent statutes, it should be recognized that various other modifications and adaptations of the invention may be made by those persons who are skilled in the relevant art without departing from either the spirit or the scope of the appended claims.

We claim:

1. An interlocking type mechanism positioned intermediate first and second end portions of a drawbar member portion of a slackless type drawbar assembly which is utilized in coupling adjacently disposed ends of a pair of railway freight cars together in a substantially semipermanent fashion, said interlocking type mechanism comprising:

(a) an elongated member portion engageable at a first end thereof to an end of a first male connection member and at an axially opposed second end thereof to an end of a second male connection member of such slackless drawbar assembly, at least one of said elongated member portion and such ends of such first and such second male connection members including a hollow portion so that one of said elongated member portion can be disposed in such hollow portion of such ends of such first and such second male connection members and such ends of such first and such second male connection members can be disposed in said hollow portion of said elongated member portion;

(b) a first aperture, having a first predetermined elongated slot-like shape, formed through said elongated member portion adjacent each of said first end and said axially opposed second end thereof, said first aperture including at least one end portion inclusive of a tapered wall-like portion;

(c) a second aperture, having a second predetermined elongated slot-like shape, formed through each of such ends of such first and such second male connection members so that each of said second apertures corresponds with one of said first apertures formed through said first and said second ends, respectively, of said elongated member portion, each of said second apertures including at least one end portion inclusive of a tapered wall-like portion disposed substantially opposite said tapered wall portion formed on said at least one end portion of said first aperture corresponding thereto; and (d) a pair of plate like connection means, each having a third predetermined shape, a first one of said pair of plate like connection means being disposed in both said first aperture formed through said first end of said elongated member portion and a respective one of said second apertures formed through such first male connection member, and a second one of said pair of plate like connection means being disposed in both said first aperture formed through said axially opposed second end of said elongated member portion and a respective one of said second apertures formed through such second female connection member, for connecting said elongated member portion to such ends of such first and such second male connection members in a slackless manner.

2. An interlocking type mechanism for a slackless type drawbar assembly, according to claim 1, wherein said elongated member portion is hollow.

3. An interlocking type mechanism for a slackless type drawbar assembly, according to claim 1, wherein each of such ends of such first and such second male connection members is generally hollow and said first end of said elongated member portion is disposed in such end of such first male connection member and said axially opposed second end of said elongated member portion is disposed in such end of such second male connection member of such slackless drawbar assembly.

4. An interlocking type mechanism for a slackless type drawbar assembly, according to claim 3, wherein said elongated member portion is hollow.

5. An interlocking type mechanism for a slackless type drawbar assembly, according to claim 1, wherein said third predetermined shape of each of said first and said second ones of said pair of plate like connection means is wedge shaped.

6. An interlocking type mechanism, according to claim 1, wherein said interlocking mechanism further includes a retaining means engageable with:

(a) said first one of said pair of plate like connection means and one of said first end of said elongated member portion and such end of such first male connection member adjacent said first and said second apertures corresponding thereto for retaining said first one of said pair of plate like connection means in said first and said second apertures corresponding thereto; and (b) said second one of said pair of plate like connection means and one of said second end of said elongated member portion and such end of such second male connection member adjacent said first and said second apertures corresponding thereto for retaining said first one of said pair of plate like connection means in said first and said second apertures corresponding thereto.

7. An interlocking type mechanism for a slackless type drawbar assembly, according to claim 6, wherein said retaining means is at least one of a weldment, a bolt, and a friction fit.

8. An interlocking type mechanism for a slackless type drawbar assembly, according to claim 7, wherein said retaining means is said friction fit.

9. An interlocking type mechanism for a slackless type drawbar assembly, according to claim 1, wherein said interlocking type mechanism further includes a weldment disposed around said elongated member portion adjacent an outermost edge of such end of such first male connection member and around said elongated member portion adjacent an outermost edge of such end of such second male connection member.

10. An interlocking type mechanism for a slackless type drawbar assembly, according to claim 1, wherein at least one of said pair of plate like connection means has a generally rectangular cross sectional shape disposed in a vertical plane substantially perpendicular to a longitudinal axis of said at least one of said pair of plate like connection means.

11. An interlocking type mechanism for a slackless type drawbar assembly, according to claim 10, wherein each one of said pair of plate like connection means has a generally rectangular cross sectional shape disposed in said vertical plane substantially perpendicular to said longitudinal axis of said each one of said pair of plate like connection means.

12. An interlocking type mechanism for a slackless type drawbar assembly, according to claim 11, wherein said at least one of said pair of plate like connection means has a generally rectangular cross sectional shape disposed in a vertical plane substantially along said longitudinal axis of said at least one of said pair of plate like connection means.

13. An interlocking type mechanism for a slackless type drawbar assembly, according to claim 1, wherein said elongated member portion is formed from a length of pipe.

14. An interlocking type mechanism for a slackless type drawbar assembly, according to claim 1, wherein each of said first and said second pair of said plate like connection means engages only a portion of said first aperture and said second aperture corresponding thereto.

15. An interlocking type mechanism positioned intermediate first and second end portions of a drawbar member portion of a slackless type drawbar assembly which is utilized in coupling adjacently disposed ends of a pair of railway freight cars together in a substantially semipermanent fashion, said interlocking type mechanism comprising:

(a) an elongated member portion having a first end and an axially opposed second end, said first end being engageable to an end of a first male connection member of such slackless drawbar assembly and said second end being engageable to an end of a second male connection member of such slackless drawbar assembly, such ends of such first and such second male connection members each defining a hollow portion therein within which said first and said seconds ends, respectively, of said elongated member portion can be disposed;

(b) a pair of first elongated slot shaped apertures formed within said elongated member portion, one of which is located adjacent said first end of said elongated member portion and another of which is located adjacent said second end of said elongated member portion, said one and said another first apertures each including at least one end portion inclusive of a tapered wall-like portion;

(c) a pair of second elongated slot shaped apertures one of which formed within such first male connection member adjacent such end thereof and another of which formed within such second male connection member adjacent such end thereof such that said one and said another first apertures of said elongated member portion correspond with said one and said another second apertures, respectively, of said first and said second male connection members, said one and said another second apertures each including at least one end portion inclusive of a tapered wall like portion, said tapered wall portions of said one and said another second apertures each disposed substantially opposite a respective one of said tapered wall portions of said one and said another first apertures respectively; and (d) a pair of plate like connection means one of which being disposed in both said one first aperture and said one second aperture and another of which being disposed in both said another first aperture and said another second aperture so as to connect said first and said second ends of said elongated member portion to such ends of such first and such second male connection members, respectively, in a slackless manner.

* * * * *